US005415383A

United States Patent [19]

Ausilio

[11] Patent Number: 5,415,383

[45] Date of Patent: May 16, 1995

[54] CLAMP ARM WITH SLIP PLANE POSITIONING

[76] Inventor: John S. Ausilio, 37502 Fiore Trail, Mt. Clemens, Mich. 48043

[21] Appl. No.: 89,853

[22] Filed: Jul. 12, 1993

Related U.S. Application Data

[63] Continuation-in-part of Ser. No. 891,810, Jun. 1, 1992, Pat. No. 5,226,638.

[51] Int. Cl.[6] ..... B25B 1/02

[52] U.S. Cl. ..... 269/238; 269/285

[58] Field of Search ..... 269/282, 238, 285; 228/140; 254/129

[56] References Cited

U.S. PATENT DOCUMENTS

| | | |
|---|---|---|
| 260,777 | 7/1882 | Patton . |
| 782,056 | 2/1905 | Richardson . |
| 941,543 | 11/1909 | Sistek et al. . |
| 997,243 | 7/1911 | Daley . |
| 2,126,997 | 8/1938 | Kramer . |
| 2,579,151 | 12/1951 | Lloyd . |
| 2,609,717 | 9/1952 | Maroth . |
| 3,454,971 | 7/1969 | Wolf . |
| 3,838,487 | 10/1974 | Maeda . |
| 4,052,047 | 10/1977 | Bailey . |
| 4,376,331 | 3/1983 | Clark . |
| 4,518,155 | 5/1985 | Lehmann . |
| 4,789,134 | 12/1988 | Tenuto et al. ..... 254/129 |
| 4,834,352 | 5/1989 | Thornton . |

*Primary Examiner*—Robert C. Watson
*Attorney, Agent, or Firm*—Basile and Hanlon

[57] ABSTRACT

A clamp having slip plane positioning enables a clamp nose and an attached pressure foot which are initially non-permanently attached to the clamp arm to be brought into a final predetermined coordinate position before the clamp nose is fixedly attached to the clamp arm. The clamp nose has the pressure foot mounted at one end. An open-ended slot is formed at the other end of the clamp nose and slidingly engages opposed side walls of one end of the clamp arm. In one embodiment, a fastener threadingly extends through a portion of the clamp nose surrounding the slot into engagement with the clamp arm to non-permanently attach the clamp nose to the clamp arm. In another embodiment, aligned bores and slots are formed in adjoining surfaces of the clamp nose and the clamp arm and receive fasteners therethrough to non-permanently mount the clamp nose on the clamp arm. The clamp nose and the pressure foot attached thereto are positionally adjusted with respect to the clamp arm at final assembly to bring the pressure foot into a predetermined coordinate position before the clamp nose is fixedly secured to the clamp arm.

10 Claims, 5 Drawing Sheets

CLAMP ARM WITH SLIP PLANE POSITIONING

CROSS-REFERENCE TO APPLICATION

This application is a continuation-in-part application of U.S. patent application Ser. No. 07/891,810, filed Jun. 1, 1992, now U.S. Pat. No. 5,226,638 in the name of John S. Ausilio and entitled CLAMP ARM WITH SLIP PLANE POSITIONING.

BACKGROUND OF THE INVENTION

1. Field of the Invention

The present invention relates, in general, to clamps and, more specifically, to pivotal clamps for holding a workpiece during manufacturing operations.

2. Background Description

Clamps are widely employed to hold two or more parts together during a manufacturing operation. In automotive assembly plants, for example, clamps are used to hold two or more metal sheets or parts together under pressure and at a predetermined coordinate position during welding, piercing, hemming and other manufacturing operations.

Typically, such clamps include a riser which is mounted via a mounting plate to a tool base. A clamp with at least one pivotal clamp arm is mounted on the upper end of the riser and is movable between an open position and a closed, workpiece engaging position, either manually or under power by means of a fluid cylinder, for example. In such a clamp, two pressure feet or N/C blocks are respectively mounted on one end of the clamp arm through a clamp nose member attached to the pivotal clamp arm and to the upper end of the riser to establish a predetermined coordinate position therebetween when the clamp arm is moved to the closed position bringing the pressure feet into engagement with the workpiece.

Due to close tolerances required for accurate automobile assembly, the pressure feet, clamp arm and clamp nose are usually specifically designed and machined to specified dimensions and tolerances for each application. A typical clamp construction includes a clamp nose having a slot extending inward from one end which engages opposite side walls of one end of the pivotal clamp arm. All mating surfaces on the clamp arm and the clamp nose require machining to insure accurate final assembly dimensions when the clamp nose is welded to the clamp arm. Furthermore, the pressure foot is attached to the opposite end of the clamp nose either directly or indirectly by means of an intermediate mounting bracket. Again, all mating surfaces between the clamp nose and the pressure foot require precision machining for accurate buildup dimensions in the clamp.

These special clamp parts require additional design time to create drawings for each part of each clamp. Additional time is also required to machine each part to the prescribed dimensions prior to assembly of the clamp. All of such design and machining time contributes to the cost of the clamp. Furthermore, at final assembly, dimensional differences between the clamp and the sheet metal often require additional machining and/or the use of shims to position the pressure feet at the desired coordinate positions.

Thus, it would be desirable to provide a clamp for manufacturing operations which is constructed of as many standard parts as possible so as to reduce design, construction and assembly time of the clamp. It would also be desirable to provide a clamp which can be loosely assembled prior to welding of the clamp parts in the desired coordinate positions at final assembly of the clamp at the use site.

SUMMARY OF THE INVENTION

The present invention is a clamp having slip plane positioning which enables the clamp nose and pressure foot of the clamp, which are initially loosely attached to the clamp arm, to be brought into a final, predetermined coordinate position with respect to a workpiece before the clamp nose is fixedly attached to the clamp arm.

In one embodiment, the clamp includes a base having a clamp arm pivotally mounted thereon. The clamp arm is movable between first and second positions. A clamp nose is adjustably engageable with one end of the clamp arm. A pressure foot is attached to one end of the clamp nose and includes a workpiece engaging surface which engages the workpiece when the clamp is moved to the second, closed position. Means are provided for non-permanently securing the clamp nose to the clamp arm prior to final adjustment and the fixed attachment of the clamp nose to the clamp arm.

Preferably, the slot is formed between first and second legs at one end of the clamp nose. The non-permanent securing means comprises a set screw threadingly extendable through one of the first and second legs on the clamp nose into releasable engagement with the clamp arm to non-permanently attach the clamp nose to the clamp arm. When the clamp nose and pressure foot are brought into the desired final coordinate position in engagement with the workpiece at final assembly of the tool containing the clamp, the clamp nose is permanently fixed to the clamp arm by welds at various locations on the clamp nose and clamp arm.

In another embodiment, the clamp of the present invention includes a clamp arm having first and second opposed ends. Means are connected to the first end of the clamp arm for pivoting the second end of the clamp arm between first and second positions. A clamp nose has first and second spaced legs on opposite sides of a slot which slidably engage and surround the second end of the clamp arm. A pressure foot is mounted on the clamp nose for engaging a workpiece when the second end of the clamp arm is in the second position. At least one transverse bore is formed in one of the second end of the clamp arm and the first and second legs of the clamp nose. Slot means are formed in the other of the second leg of the clamp arm and the first and second legs of the clamp nose and aligned with the at least one through bore. The slot means has a width greater than the diameter of the through bore. Fastener means are extendible through the aligned bore and slot means for non-permanently securing the clamp nose to the clamp arm in an adjustably selectible position. Finally, means are provided for permanently attaching the clamp nose to the clamp arm in a predetermined coordinate position with respect to the workpiece.

In a preferred example of this embodiment, at least two spaced bores are preferably formed in the second end of the clamp arm. A slot is formed in each of the first and second legs of the clamp nose and aligned with the opposed slot and bores to receive the fastener means therethrough. Preferably, the fastener means comprises a threaded bolt and nut and a precision washer mountable about the bolt. The precision washer has a central aperture slightly larger than the outer diameter of the threaded bolt so as to be mounted over the bolt in a close or slip fit. The precision washer and bolt are assembled such that, when the bolt extends through the aligned bore and slots, the washer is disposed between one of the legs of the clamp nose and the head of the bolt. Permanent welds may be formed between the precision washer and the adjacent leg of the clamp nose to permanently attach the clamp nose to the clamp arm after the clamp nose has been adjusted into a predetermined position with respect to the clamp arm and the workpiece. The precision washer then acts as a dowel to fixedly maintain the bolt in a fixed position permanently forming the clamp nose to the clamp arm.

This embodiment, like the first embodiment described above, provides slip plane positioning of the clamp nose with respect to the clamp arm since the slot has a slightly greater width than the diameter of the bore so as to enable the clamp nose to be adjusted vertically a predetermined amount in either direction from a horizontal axis extending centrally through the second end of the clamp arm. The slots also afford longitudinal adjustment of the clamp nose with respect to the clamp arm.

In the method of constructing a clamp according to the present invention, the method includes the steps of:

A. Pivotally mounting a clamp arm to a base for movement between first and second positions;

B. Attaching a pressure foot having a workpiece engageable surface to one end of a clamp nose;

C. Slidably engaging the clamp nose to one end of the clamp arm;

D. Non-permanently attaching the clamp nose to the clamp arm;

E. Moving the clamp arm, the clamp nose and the pressure foot into a final,predetermined workpiece engaging coordinate position;

F. Adjusting the position of the clamp nose and pressure foot with respect to the clamp arm to place the pressure foot at the desired predetermined coordinate position with respect to the workpiece; and G. Lastly, fixedly attaching the clamp nose to the clamp arm.

The clamp of the present invention affords many advantages over previously devised clamps used in manufacturing operations, such as clamps employed in the assembly of automotive vehicles. The clamp of the present invention is formed of a number of standardized components which reduces design time required for special components for each application as well as the associated machining of such specially designed components for mating engagement with other components of the clamp. The clamp of the present invention uniquely enables the clamp nose and attached workpiece engaging pressure foot to be non-permanently attached to the clamp arm during initial tryout and assembly and then brought into a final, predetermined coordinate position for engagement with a workpiece at final assembly before the clamp nose is permanently attached to the clamp arm. This eliminates the need for machining portions of the clamp or the use of shims at final assembly to bring the pressure foot into the desired coordinate position with respect to the workpiece. All of these factors contribute to a reduced overall cost for designing, constructing and installing a clamp for use in a manufacturing operation.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
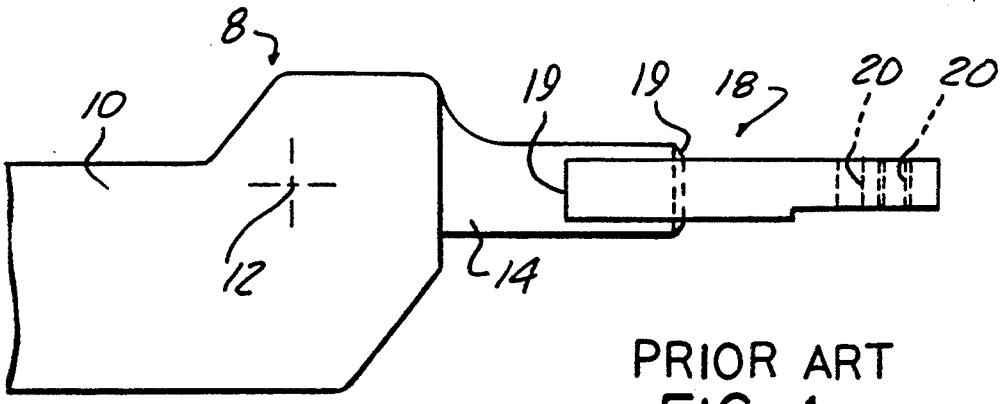
PRIOR ART FIG-1
FIG. 1 is a partial, side elevational view of a prior art clamp arm and clamp nose.
Figure 2:
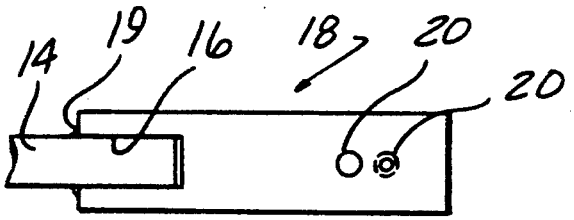
PRIOR ART FIG-2
FIG. 2 is a partial, plan view of the prior art clamp arm and clamp nose shown in FIG. 1.

Referring now to FIGS. 1 and 2, there is illustrated a prior art clamp 8 which is mountable on a suitable base, not shown, and movable between a first, open position and a second closed position, by manual or powered means, also not shown. Prior art clamps, such as the clamp 8 shown in FIGS. 1 and 2, typically include a clamp arm 10 which is pivotally mounted about a pivot point 12 to a base attached to a tool or work station. One end of the clamp arm 10, which is not depicted in FIG. 1, is connected to a power drive means, such as a fluid cylinder, for pivoting the clamp arm 10 between open and closed or first and second positions, respectively. A small end extension 14 is integrally formed with or joined to the clamp arm 10 and extends outward therefrom. The outer end of the end extension 14 slidably engages a slot 16 formed in one end of a clamp nose 18. The clamp nose 18 is fixedly joined to the end extension 14 by means of welds denoted by reference number 19 which are formed at a number of different locations at the juncture of adjoining surfaces of the end extension 14 and the clamp nose 18.

The mating side wall surfaces of the end extension 14 and the portion of the clamp nose 18 forming the slot 16 are machined to precise dimensions for accurate dimensional assembly of the clamp. At least one and preferably two bores, both denoted generally by reference number 20, are formed in the opposite end of the clamp nose 18. The bores 20 receive suitable fasteners, not shown, for attaching a pressure foot or N/C block, also not shown, to the clamp nose 18. The pressure foot has a workpiece engaging surface for securely engaging a workpiece when the clamp 8 is moved to the second closed position thereby holding the workpiece under pressure in a fixed dimensional coordinate position during manufacturing operations on the workpiece.

While this construction affords a clamp which is effective in manufacturing operations, the machining required between the mating surfaces of the end extension 14 and the slot 16 in the clamp nose 18 requires additional design time to prepare detailed drawings for each separate part of the clamp 8 as well as additional machining time to form the parts to the desired dimensions. Furthermore, the clamp nose 18 is fixed to the end extension 14 by welds 19 during initial assembly of the tool containing the clamp 8. When the tool is moved into its final workstation, it is common for the clamp 8 to require additional adjustments to bring the pressure foot attached to the clamp nose 18 into the desired dimensional coordinate position with respect to a workpiece. This usually results in machining of the pressure foot and/or clamp nose or the use of additional metal shims. This increases the assembly time of the clamp and, thereby, the overall cost of the clamp 8. As numerous clamps are usually contained in each tool, the overall cost of the tool is accordingly increased by the additional design, assembly and installation time required for each clamp.

As shown in FIGS. 3, 4, 5 and 6, a clamp 30 is depicted which overcomes the problems described above with respect to previously devised clamps in that the clamp may be constructed with reduced design time, assembly time and installation time. In general, the clamp 30 is provided with slip plane positioning of the clamp nose and pressure foot with respect to the clamp arm to enable the clamp nose and pressure foot to be brought into a final specific dimensional coordinate position with respect to a workpiece during final assembly before the clamp nose is fixedly connected to the clamp arm.

Figure 3:
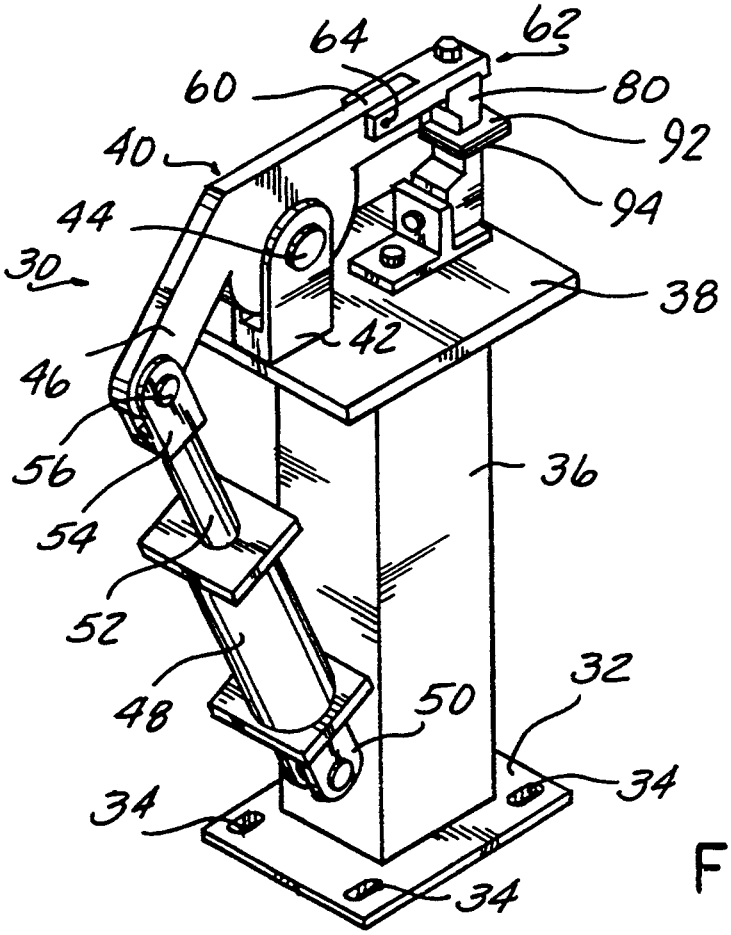
FIG. 3 is a perspective view of one embodiment of a clamp constructed according to the method of the present invention.
Figure 4:
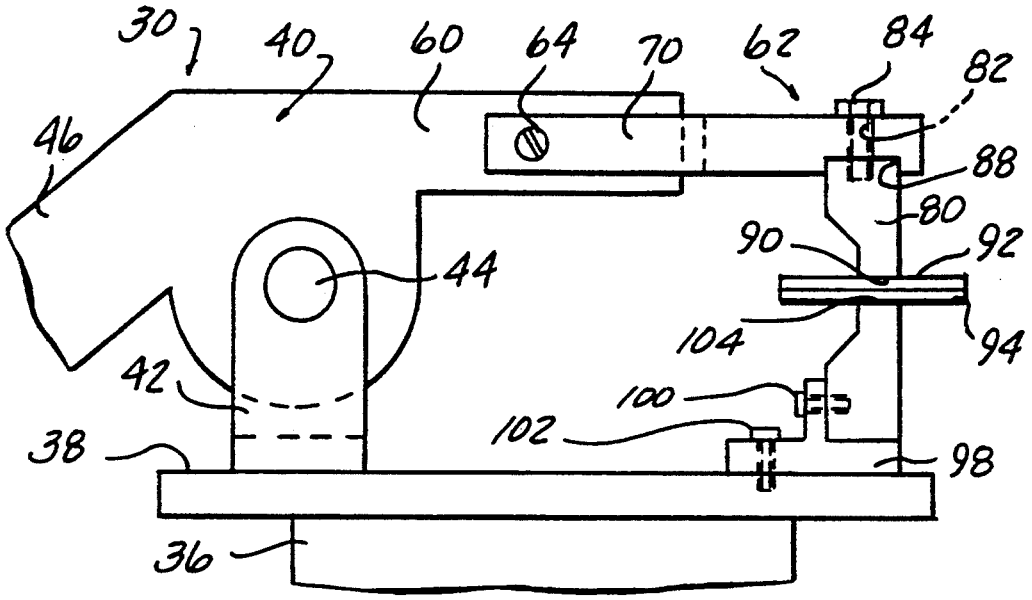
FIG. 4 is a partial, side elevational view of the clamp shown in FIG. 3.
Figure 5:
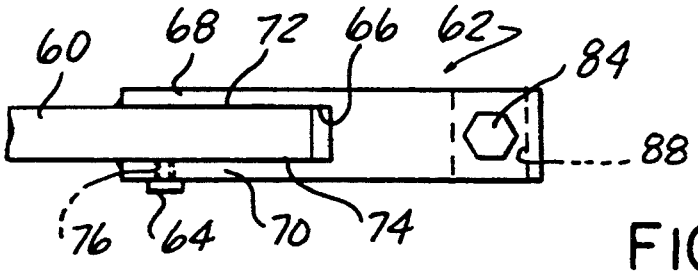
FIG. 5 is a partial, plan view of the clamp shown in FIG. 4.
Figure 6:
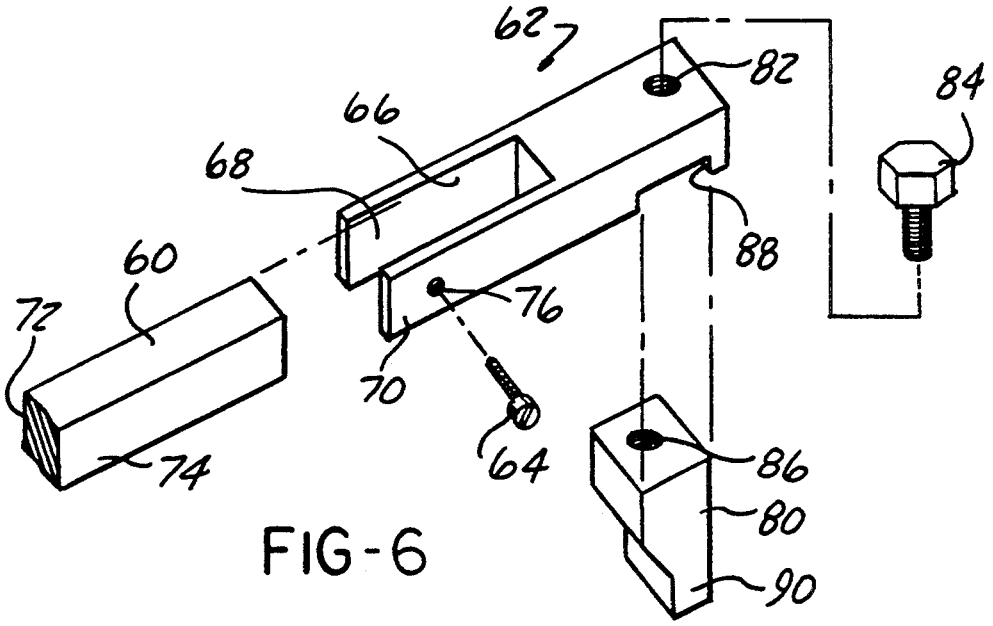
FIG. 6 is a partial, exploded, perspective view showing the assembly of the clamp arm, clamp nose and pressure foot shown in FIGS. 3–6.

As shown in FIGS. 3 and 4, the clamp 30 includes a base or weldment which is depicted in one exemplary embodiment. The weldment includes a lower mounting plate 32 having apertures 34 formed therein which receive fasteners to attach the clamp 30 to a tool or base. A riser 36 of any form and construction is attached to the lower mounting plate 32 and extends outward therefrom. The riser 36 may be in the form of the illustrated tubular member; but also can be formed of welded plates, etc. The riser 36 is formed with a predetermined length so as to position an upper mounting plate 38 which is attached to one end of the riser 36 at a predetermined dimension with respect to the tool. A pivotal clamp arm 40 is pivotally mounted on the upper mounting plate 38 and is movable between a first open position to a second closed position as shown in FIGS. 3 and 4.

By way of example only, a trunion 42 is mounted on the upper mounting plate 38 and carries a pivot pin 44 which extends through an intermediate portion of the clamp arm 40 for pivotally mounting the clamp arm 40 to the upper mounting plate 38 on the riser 36. A first end 46 of the clamp arm 40 extends outward from the pivot pin 44 and is attached to a power moving means 48. The power moving means 48 may be any suitable power source, such as a fluid, i.e., air or hydraulic, cylinder. As is conventional, the cylinder is connected at one end by a trunion 50 attached to the riser 36 on the lower mounting place 32. An extensible rod 52 in the cylinder carries another trunion 54 at its outer end which is pivotally connected by means of a pivot pin 56 to the first end 46 of the clamp arm 40. In this manner, retraction of the rod 52 into the cylinder 48 will cause the clamp arm 40 to pivot about the pivot pin 44 and move the other end of the clamp arm 40 to the first, open position. Extension of the piston rod 52 to the position shown in FIG. 3 will cause the clamp arm 40 to pivot to the second, closed position bringing the attached components of the clamp 30, described hereafter, into engagement with a workpiece.

It will also be understood that the clamp arm 40 may be manually moved between the first and second positions in which instance the first end 46 acts as or is connected to a handle for pivoting the clamp arm 40.

The clamp arm 40 includes a second end 60 which extends outward from the pivot point 44 opposite from the first end 46. A clamp nose denoted in general by reference number 62 slidably engages the second end 60 of the clamp arm 40 and is non-permanently attached thereto, prior to final assembly, by a non-permanent securing means 64. A slot 66 is formed in one end of the clamp nose 62 and extends from the one end of the clamp nose 62. The slot 66 forms first and second spaced legs 68 and 70, respectively, disposed on opposite sides of the slot 66. The slot 66 is dimensioned to closely, but slidably engage opposed side surfaces 72 and 74 on the second end 60 of the clamp arm 40.

An aperture 76 is formed in the leg 70 of the clamp nose 62 and threadingly receives the non-permanent securing means 64, which is depicted by way of example only as being a set screw. The set screw 64 threadingly extends through the aperture 76 in the leg 70 of the clamp nose 62 into non-permanent, temporary engagement with the side wall 74 of the second end 60 of the clamp arm 40 to non-permanently hold the clamp nose 62 to the clamp arm 40. This non-permanent engagement, on the other hand, also provides slip plane positioning of the clamp nose 62 with respect to the clamp arm 40 such that the clamp nose 62 may be moved longitudinally with respect to the second end 60 of the clamp arm 40 as well as vertically with respect to the second end 60 of the clamp arm 40 to bring the outer end of the clamp nose 62 and the attached pressure foot into any desired dimensional coordinate position with respect to a workpiece, as described hereafter.

An upper pressure foot or N/C block 80 is attached to the outer end of the clamp nose 62 by suitable means. By way of example only, a bore 82 is formed in the outer end of the clamp nose 62 and receives a fastener 84 therethrough which engages a corresponding bore 86 in the upper end of the pressure foot 80. A slot 88 may be formed in the lower surface of the clamp nose 62 for slidingly receiving the upper end of the pressure foot 80. The lower surface 90 of the pressure foot 80 is formed as a workpiece engaging surface and has a shape complimentary to the shape of the workpiece. By way of example only, the workpiece with which the clamp 30 of the present invention is to be used, is depicted as comprising a stack of two metal sheets 92 and 94.

A lower pressure foot or N/C Block 96 has a shape similar to that of the upper pressure foot 80; but is inverted so as to engage the lower metal sheet 94, as shown in FIGS. 3 and 4. The lower pressure foot 96 is connected to a bracket 98 by means of suitable fasteners 100. The bracket 98, meanwhile, is mounted by fasteners 102 or by welds to the upper mounting plate 38 on the riser 36.

The upper surface 104 of the lower pressure foot 96 also serves as a workpiece engaging surface and has a shape complimentary to the shape of the lower metal sheet 94 at its point of contact with the lower metal sheet 94. The workpiece engaging surfaces 90 and 104 of the upper and lower pressure feet 80 and 96, respectively, are spaced apart a predetermined dimension or distance equal to the thickness of the stack of metal sheets 92 and 94. This dimension and the position of both pressure feet 80 and 96 must be accurately maintained in order to assemble the metal sheets 92 and 94 into their desired configuration.

The upper and lower pressure feet 80 and 96 may be formed of any suitable material, such as a high strength steel which is machined to the desired configuration. Alternately, urethane and composite materials may also be employed to form the pressure feet 80 and 96 to the desired configuration, without the need for additional machining or forming operations.

In assembling the clamp 30 of the present invention, standardized components including the upper and lower mounting plates 38 and 34, respectively, and the riser 36 are constructed. The drive means 48, in the case of a powered clamp, is then attached at one end to the riser 36, as shown in FIG. 3 and described above. The clamp arm 40 is then pivotally attached to the upper mounting plate 38 and the first end 46 thereof attached to the drive means 48. Activation and deactivation of the drive means 48 causes reciprocal extension and retraction of the piston rod 52 which results in pivotal movement of the clamp arm 40 between the first and second positions.

The upper pressure foot 80 is then attached to the clamp nose 62 by sliding the upper end of the pressure foot 80 into the slot 88 in the clamp nose 62 and joining the pressure foot 80 to the clamp nose 62 by means of the fastener 84. The clamp nose 62 with the attached upper pressure foot 80 is then slidingly engaged with the second end 60 of the clamp arm 40 by bringing the spaced legs 68 and 70 of the clamp nose 62 into engagement with opposed side wall surfaces 72 and 74, respectively, of the second end 60 of the clamp arm 40. The non-permanent securing means, such as the set screw 64, is then threadingly engaged through the aperture 76 in the second leg 70 of the clamp nose 62 into releasable engagement with the side wall 74 of the clamp arm 40. This holds the clamp nose 62 in a non-permanent position with respect to the clamp arm 40; but enables the clamp nose 62 on the attached upper pressure foot 80 to be urged into other positions during final assembly of the clamp to bring the upper pressure foot 80 into a desired dimensional coordinate position with respect to the workpiece and the lower pressure foot 96.

During final assembly, the clamp arm 40 is pivoted to the closed position shown in FIGS. 3 and 4, bringing the upper pressure foot 80 into proximity with or in contact with the upper metal sheet 92. If adjustments are needed, the set screw 64 can be loosened to enable the clamp nose 62 and the attached upper pressure foot 80 to be moved either or both longitudinally outward or inward with respect to the clamp arm 40 as well as vertically with respect to the clamp arm 40 or to any angular position with respect to the clamp arm 40 to bring the upper pressure foot 80 into the desired dimensional relationship with respect to the metal sheets 92 and 94 and/or the lower pressure foot 96.

Figure 7:
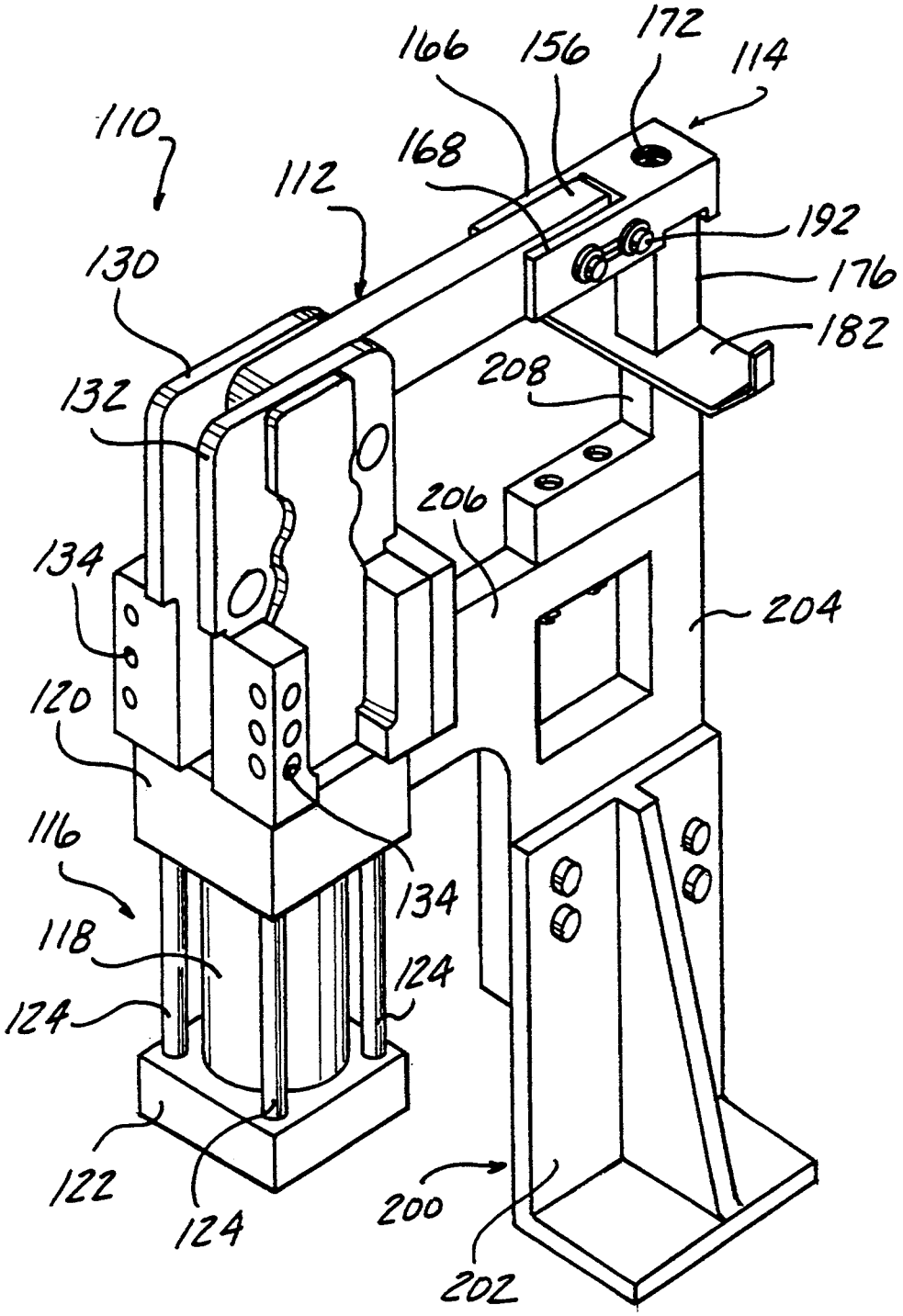
FIG. 7 is a perspective view of a second embodiment of a clamp of the present invention.
Figure 8:
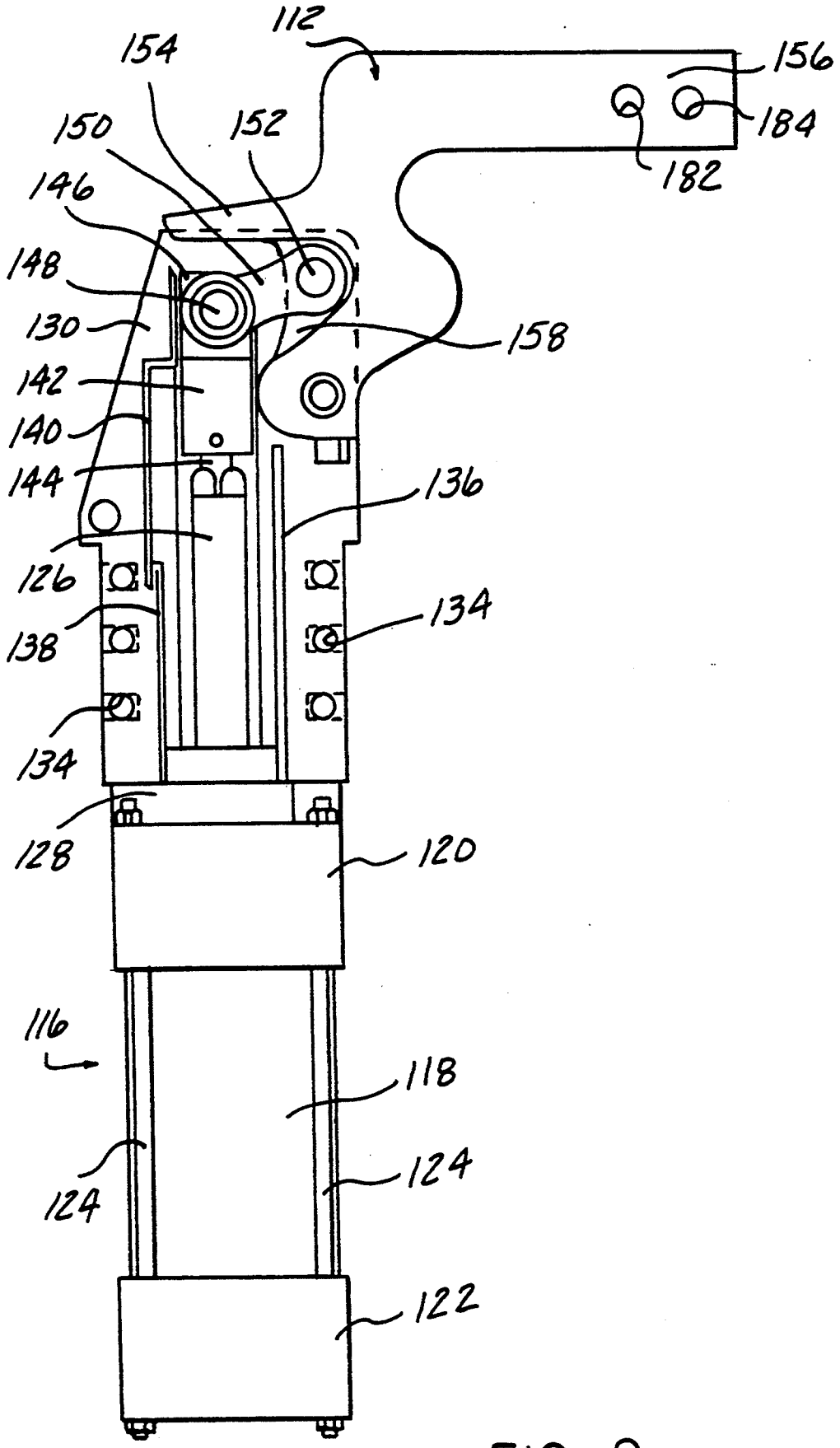
FIG. 8 is a partially broken away, side elevational view of a portion of the clamp shown in FIG. 7.
Figure 9:
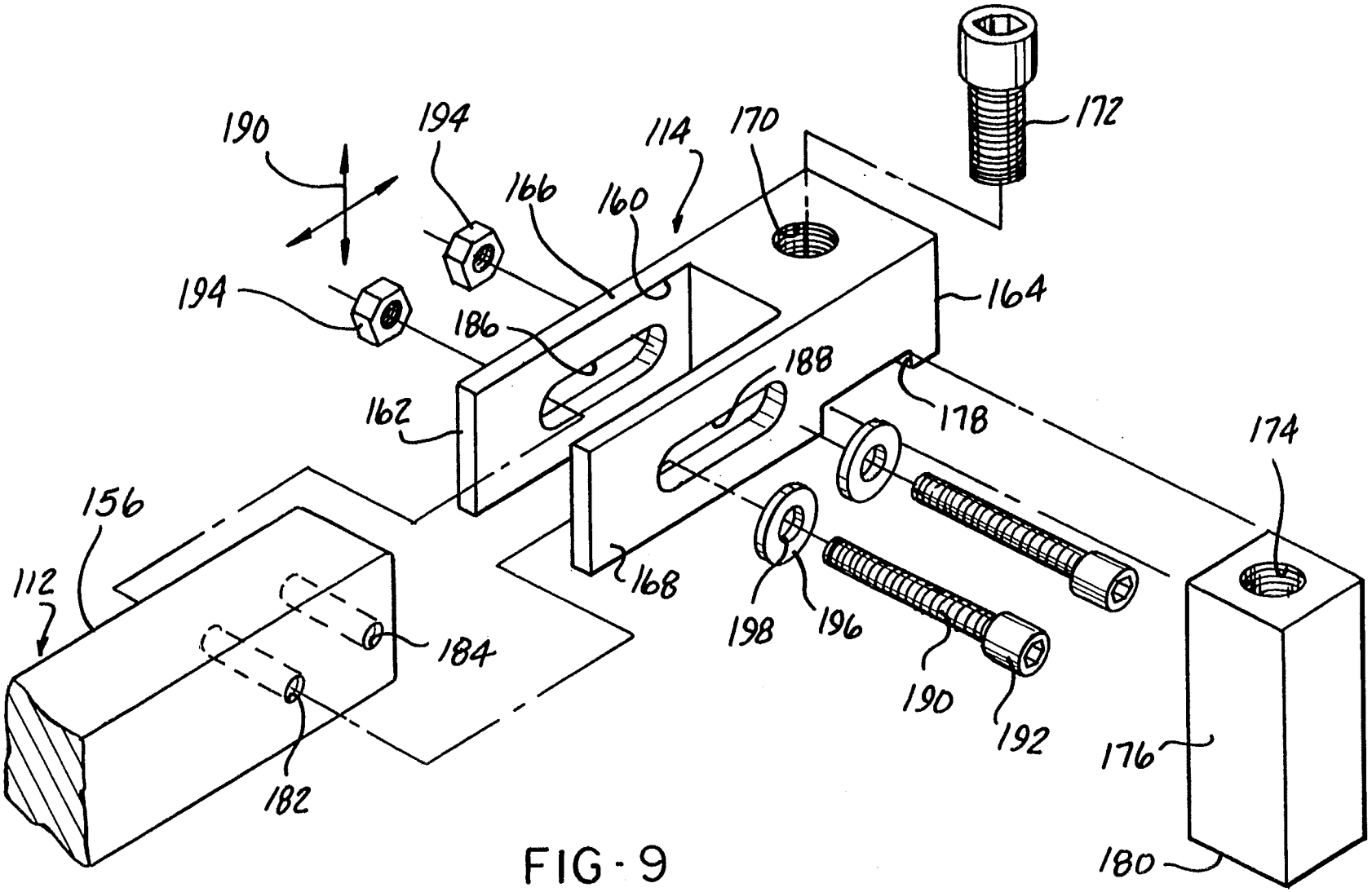
FIG. 9 is an exploded, perspective view of the clamp nose and clamp arm of the second embodiment of the clamp shown in FIG. 7.

Referring now to FIGS. 7–9, there is depicted a second embodiment of a clamp 110 constructed in accordance with the teachings of the present invention. The clamp 110 includes a pivotal clamp arm 112 and a clamp nose 114. Means are provided for pivoting the clamp arm 112, and the clamp nose 114 attached thereto, as described hereafter, between first and second positions.

As shown in FIGS. 7 and 8, the pivoting means, by example only, comprises a fluid operated cylinder 116 having a closed chamber formed within a cylindrical body 118. End caps 120 and 122 are mounted on opposite ends of the cylindrical body 118 and are interconnected by means of connecting rods 124.

As is conventional, a piston, not shown, is mounted in the cylindrical body 118 of the cylinder 116 and is moved by the bidirectional application of pressurized fluid to opposite sides thereof to cause a piston rod 126 connected to one end of the piston and extending outwardly from one end of the cylinder 118 through the end cap 120 to reciprocate in extendible and retractible, linear directions with respect to the cylinder 116.

A mounting plate 128 is fixedly connected to the end cap 120 and has a central aperture through which the piston rod 126 slidably extends. The mounting plate 128 supports by means of fasteners, not shown, a pair of spaced, plate-like support members 130 and 132. As shown in FIGS. 7 and 8, each of the support members 130 and 132 includes a number of spaced bores 134 which are used to receive suitable fasteners for fixedly mounting the support members 130 and 132 to tooling, such as a weldment or base 200 shown in FIG. 7, to stationarily position the clamp 110 in a fixed position with respect to a workpiece.

A pair of spaced, strip-like covers 136 and 138 are disposed between the support members 130 and 132 and are attached, such as by welding, to the support plate 130 on opposite sides of the piston rod 126. An additional cover member 140 is disposed in an overlapping end arrangement with the cover member 138.

Means are provided for converting linear reciprocal, bidirectional movement of the piston rod 128 to pivotal movement of a second end of the clamp arm 112. As shown more clearly in FIG. 8, such converting means includes a tubular sleeve 142 having an internally threaded bore at one end which threadingly engages a threaded adapter 144 mounted on the exterior end of the piston rod 126. An opposed end portion 146 of the tubular sleeve 142 has a flattened shape with a central bore extending therethrough which receives a pivot pin 148. The cover member 140 is fixedly attached to the flattened portion of the sleeve 142 and is movable therewith.

Also mounted to the pivot pin 148 is a first end of a link 150. The opposite, second end of the link 150 is fixed to a pivot pin 152 extending between the support plates 130 and 132.

The clamp arm 112 is formed with a first end 154 and an opposed second end 156. The first end 154 of the clamp arm 112 has a recessed portion 158 which has a central bore extending therethrough fixedly mountable about the pivot pin 152. In this manner, linear extension and retraction of the piston rod 126 due to activation of the cylinder 116 results in pivotal movement of the first end of the link 150. This causes pivotal movement of the pin 150 and the attached recessed portion 158 of the clamp arm 112 thereby pivoting the first end 154 of the clamp arm 112 in one direction and pivoting of the second end 156 of the clamp arm 112 in an opposite direction so as to move the second end 156 of the clamp arm 112 between a first position spaced from the workpiece and a second position in which the clamp arm 112 brings the pressure foot, described hereafter, into engagement with a workpiece to hold the workpiece in a predetermined coordinate position.

As shown in FIGS. 7 and 9, the clamp nose 114 slidably engages and surrounds the second end 156 of the clamp arm 112. A slot 160 is formed in the clamp nose 114 and extends inward from an open end adjacent a first end 162 of the clamp nose 114 toward but spaced from the opposed second end 164 of the clamp nose 114. The slot 160 forms first and second spaced legs 166 and 168, respectively, in the clamp nose 114. The width of the slot 160 is chosen so as to slidably yet closely match the width of the second end 156 of the clamp arm 112 to enable the clamp nose 114 to closely fit around the clamp arm 112, while still being movable with respect to the clamp arm 112.

As in the first embodiment of the present invention, a through bore 170 is formed in the clamp nose 114 adjacent the second end 164 thereof. A threaded fastener 172 is extendible through the bore 170 and engages a mating threaded bore 174 formed in a pressure foot or N/C block 176. By way of example, a transverse extending slot 178 may be formed in a bottom surface of the second end 164 of the clamp nose 114 to slidably receive one end of the pressure foot 176 therein. A lower surface 180 of the pressure foot 176 is designed as a workpiece engaging surface and has a shape complementary to the shape of the workpiece 182, shown in FIG. 7, with which it is brought into engagement.

By way of example only, the weldment 200 includes a mounting base 202 attachable to external tooling, etc. A riser 204 is attached to the base 202 and includes an arm or side portion 206 to which one or both of the support plates 130 and 132 are attached by suitable fasteners. An upper portion of the riser 204 has a lower workpiece support member 208 mounted thereon. The lower workpiece member 208 is opposed to and spaced from the pressure foot 176 by a distance equal to the thickness of the workpiece 182 or workpieces. The supper surface of the lower workpiece support has a shape generally complimentary to the workpiece engaging surface of the pressure foot 176 and to the lower surface of the workpiece 182.

In this embodiment, the means for non-permanently affixing the clamp nose 114 to the second end 156 of the clamp arm 112 includes at least one and, preferably, a pair of axially spaced through bores 182 and 184 which extend transversely through the second end 156 of the clamp arm 112. The clamp nose 114 includes a pair of identically shaped, aligned slots 186 and 188 which are each axially formed in the first and second legs 166 and 168, respectively. The slots 186 and 188 have a width slightly greater than the O.D. of the bores 182 and 184 in the clamp arm 112 to provide a variably selectible adjustment in a vertical direction shown by arrow 190 for the clamp nose 114 on the clamp arm 112. For example, the slots 186 and 188 have a width 4 mils greater than the O.D. of the bores 182 and 184 to provide a 2 mil adjustment in either direction from the center of the bores 182 and 184.

Finally, it will be understood that the bores 182 and 184 may be formed in each leg 166 and 168 of the clamp nose 114 and a single slot 186 formed in the second end 156 of the clamp arm 112.

Fastener means are provided to non-permanently secure the clamp nose 114 in a predetermined, selectibly adjustable position on the second end 156 of the clamp arm 112. Preferably, the fastening means comprises a pair of bolts 190, each having a head 192 at one end of a threaded shank, and mating, threaded nuts 194. A precision washer 196 is provided for each bolt 190. The precision washer, as is conventionally known, has a central aperture 198 with an I.D. only slightly greater than the O.D. of the threaded shank of the bolt 190 so as to be mounted over the threaded shank of the bolt 190 in a close, slip fit. As shown in FIG. 9, the precision washers 198 are disposed between the head 192 of each bolt 190 and one of the legs, such as leg 168, of the clamp nose 114.

As in the first embodiment, after the clamp nose 114 has been loosely attached to the clamp arm 112 by loose tightening of the bolts 190 and nuts 194, and has been adjusted to bring the pressure foot 176 into a predetermined coordinate position with respect to the workpiece 182, as set forth in the method described above, the bolts 190 and nuts 194 will be tightened to non-permanently secure the clamp nose 114 in place on the second end 156 of the clamp arm 112. The clamp nose 114 is permanently and fixedly secured in the desired coordinate position on the end 156 of the clamp arm 112 by welds formed around the precision washers 196 and the adjacent surface of the leg 168 of the clamp arm 114. Due to the use of precision washers 196 and the close, slip fit between such washers 196 and the bolts 190, the washers 196 act as dowels after they have been welded to the leg of the clamp nose 114 to fixedly maintain the bolts 190 and nuts 194 attached thereto in the desired position.

The slip plane positioning afforded by the initial non-permanent attachment of the clamp nose and the upper pressure foot to the clamp arm enables the use of standardized components to form the clamp and thereby minimizes the requirement for detailed drawings of each specially designed clamp component. Assembly time for constructing the clamp is also reduced as compared to previous clamp constructions, since special machining of mating surfaces of the clamp components is not required or is done on standardized components. Further, special machining or the use of shims to bring the upper pressure foot into the desired dimensional coordinate position with respect to the lower pressure foot during initial assembly of the clamp and associated tooling is not required. This minimizes construction time for the clamp thereby adding to the cost savings for the clamp of the present invention. Finally, the slip plane positioning enables the upper pressure foot to be moved into the desired coordinate position with respect to the workpiece, such as the stack of metal sheets, and the lower pressure foot at final assembly in the manufacturing plant without the need for additional machining and/or the use of shims to effect such dimensional positioning.

What is claimed is:

1. A clamp for engaging a workpiece mounted on a support, the clamp comprising:

a clamp arm having first and second ends;

means, connected to the first end of the clamp arm, for pivoting the second end of the clamp arm between first and second positions;

a clamp nose having first and second spaced legs formed at one end forming a slot therebetween, the first and second legs slidably engaging the second end of the clamp arm;

a pressure foot mounted on the clamp nose for engaging a workpiece when the second end of the clamp arm is in the second position;

at least one transverse, through bore formed in one of the second end of the clamp arm and the first and second legs of the clamp nose;

a slot formed in the other of the second end of the clamp arm and the first and second legs of the clamp nose and aligned with the at least one through bore, the slot having a width greater than the diameter of the at least one bore;

fastener means, extendible through the aligned bore and slot, for non-permanently securing the clamp nose to the clamp arm in an adjustably selectible position; and means for permanently attaching the clamp nose to the clamp arm in a predetermined coordinate position with respect to the workpiece.

2. The clamp of claim 1 wherein the permanently attaching means comprises welds formed at predetermined locations on the clamp nose and the clamp arm to fixedly attach the clamp nose to the clamp arm.

3. The clamp of claim 1 wherein two transverse, spaced, through bores are co-axially formed in one of the second end of the clamp arm and the first and second legs of the clamp nose.

4. The clamp of claim 1 wherein the fastening means comprises:

a bolt having a threaded shank and a head;

a nut threadingly engagable with the threaded shank of the bolt; and a precision washer having a central aperture with an inner diameter substantially the same as the outer diameter of the threaded shank of the bolt to mount over the bolt in a close slip fit.

5. The claim of claim 4 wherein the permanently attaching means comprises:

welds formed between the precision washers and one of the first and second legs of the clamp nose.

6. The clamp of claim 1 wherein:

the slot includes first and second aligned slots formed in the first and second legs, respectively, of the clamp nose.

7. The clamp of claim 6 further comprising two transverse, spaced, through bores coaxially formed in the second end of the clamp arm.

8. The clamp of claim 1 wherein the pivoting means comprises:

a fluid operated cylinder having an extensible and retractible piston rod extending outward from one end thereof; and means, connected to the piston rod and the first end of the clamp arm, for converting linear reciprocal movement of the piston rod to pivotal movement of the second end of the clamp arm.

9. The clamp of claim 1 further comprising:

means for stationarily positioning an intermediate portion of the clamp arm between the first and second ends thereof.

10. A clamp for engaging a workpiece mounted on a support, the clamp comprising:

a clamp arm having first and second ends;

means, connected to the first end of the clamp arm, for pivoting the second end of the clamp arm between first and second positions;

a clamp nose having first and second spaced legs formed at one end forming a slot therebetween, the first and second legs slidably engaging the second end of the clamp arm;

a pressure foot mounted on the clamp nose for engaging a workpiece when the second end of the clamp arm is in the second position;

a pair of spaced transverse, through bores formed in the second end of the clamp arm;

a slot formed in the first and second legs of the clamp nose and alignable with the pair of through bores, each slot having a width greater than the diameter of the pair of bores;

fastener means, extendible through the aligned bores and slots, for non-permanently securing the clamp nose to the clamp arm in an adjustably selectible position, the fastening means including:

a pair of bolts, each having a threaded shank and a head;

a nut threadingly engagable with the threaded shank of each bolt; and a precision washer having a central aperture with an inner diameter substantially the same as the outer diameter of the threaded shank of the bolts each precision washer mountable over one of bolts in a close slip fit; and means for permanently attaching the clamp nose to the clamp arm in a predetermined coordinate position with respect to the workpiece, the permanently attaching means including welds formed between each of the precision washers and one of the first and second legs of the clamp nose.

* * * * *